US005650793A

United States Patent [19]

Park

[11] Patent Number: 5,650,793

[45] Date of Patent: Jul. 22, 1997

[54] CENTERED LONGITUDINAL SERIES/ SERIES COUPLING SLOT FOR COUPLING ENERGY BETWEEN A BOXED STRIPLINE AND A CROSSED RECTANGULAR WAVEGUIDE AND ANTENNA ARRAY EMPLOYING SAME

[75] Inventor: Pyong K. Park, Agoura Hills, Calif.

[73] Assignee: Hughes Missile Systems Company, Los Angeles, Calif.

[21] Appl. No.: 469,255

[22] Filed: Jun. 6, 1995

[51] Int. Cl.[6] ..... H01Q 13/18

[52] U.S. Cl. ..... 343/771; 333/114; 333/116

[58] Field of Search ..... 343/770, 771; 333/114, 116, 238; H01Q 13/10, 13/18

[56] References Cited

U.S. PATENT DOCUMENTS 4,409,595 10/1983 Park ..... 343/771
4,429,313 1/1984 Muhs et al. ..... 343/771

OTHER PUBLICATIONS

Frost et al., "The Excitation of Surface Waveguides and Radiating Slots by Strip–Circuit Transmission Lines", IRE Trans. on Microwave Theory and Tech., Oct. 1956, pp. 218–222.

*Primary Examiner*—Michael C. Wimer

*Attorney, Agent, or Firm*—Charles D. Brown; Wanda K. Denson-Low

[57] ABSTRACT

A centered longitudinal series/series coupling slot disposed between a boxed stripline and a crossed rectangular waveguide comprising a plurality of longitudinal radiating slots. The centered longitudinal series/series coupling slot is disposed orthogonal to the longitudinal radiating slots of the crossed rectangular waveguide. The centered longitudinal series/series coupling slot is longitudinally disposed along the centerline of the boxed stripline in such a way the centered longitudinal slot interacts with the stripline mode and not with the rectangular waveguide mode ($TE_{10}$ mode) in the boxed stripline. As a result of this, a highly efficient standing wave (or travelling wave) feed is provided using the centered longitudinal series/series coupling slot in the boxed stripline. The centered longitudinal series/series coupling slot comprises a transverse slot in the crossed rectangular waveguide which reduces the undesirable direct higher order mode coupling between the coupling slot and adjacent radiating longitudinal shunt slots. There is a predetermined tilt angle between the centered longitudinal series/series coupling slot and the meandering boxed stripline. The amount of coupling between the boxed meandering stripline and the rectangular waveguide is controlled by the relative tilt angle between the boxed meandering stripline and the centered longitudinal series/series coupling slot. The present invention also comprises an antenna array incorporating such centered longitudinal series/series coupling slots.

11 Claims, 2 Drawing Sheets

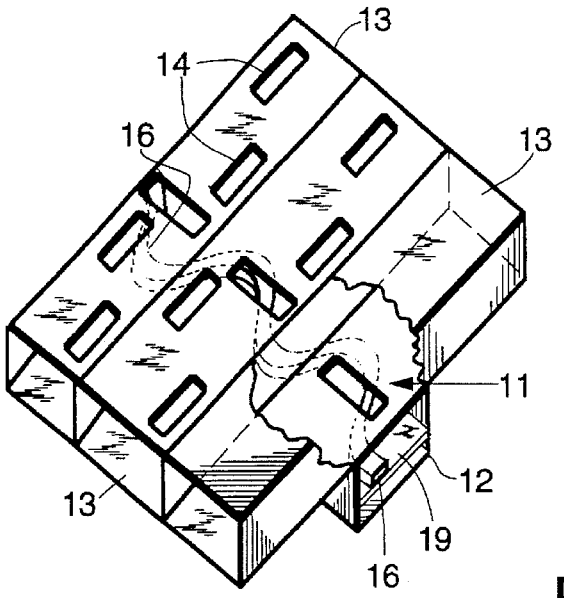
FIG. 1.
FIG. 2.
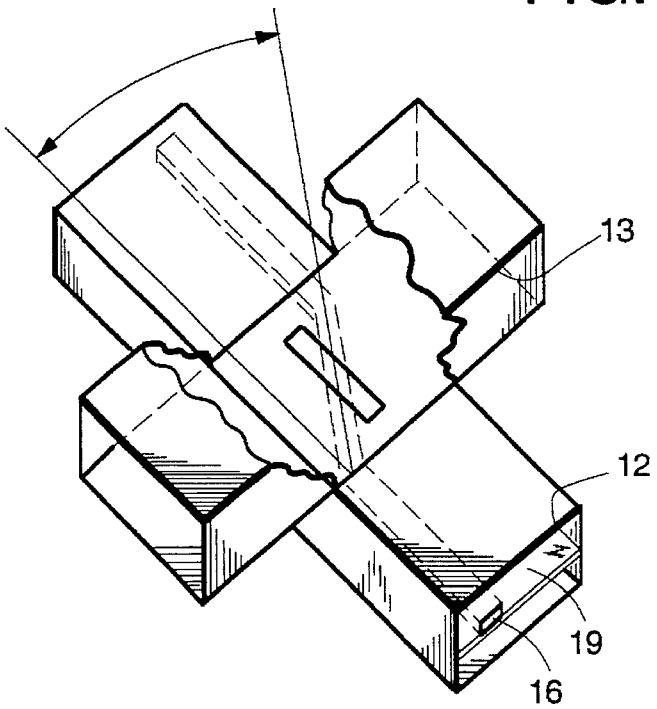

CENTERED LONGITUDINAL SERIES/SERIES COUPLING SLOT FOR COUPLING ENERGY BETWEEN A BOXED STRIPLINE AND A CROSSED RECTANGULAR WAVEGUIDE AND ANTENNA ARRAY EMPLOYING SAME

BACKGROUND

The present invention relates to antenna arrays, and more particularly, to a centered longitudinal series/series coupling slot that provides for coupling of energy between a boxed stripline and crossed rectangular waveguides employed in an antenna array.

Stripline (or microstrip line) supports currents in both the stripline and its ground plane. If a slot is cut in the ground plane, the ground plane current is disturbed by the slot. As a result of this, microwave energy is coupled to the slot and the slot is excited. If the broadside wall of a crossed rectangular waveguide is disposed on the other side of the common ground plane, energy is coupled from the stripline to the rectangular waveguide. However, the excited slot "sees" an undesirable parallel transmission line mode on the stripline side. In order to eliminate coupling to the undesirable parallel transmission line mode, the coupling slot is covered by a box on the stripline side. However, the slot not only couples to the stripline mode but also couples to the undesirable waveguide mode in the boxed stripline. By reducing the width of the box to less than one-half a wavelength to eliminate the waveguide mode in the boxed stripline, the resonant length of the coupling slot increases due to the sidewall loading so that it is difficult to cascade the coupling slot to form a standing wave or travelling wave feed.

The slots of a conventional planar shunt slot array antenna are typically fed by tilted series/series coupling slot disposed between two crossed rectangular waveguides. The direct higher order mode coupling between the tilted coupling slot and a neighboring longitudinal radiating slot is strong. Furthermore, the amount of direct higher order mode coupling from the tilted coupling slot to the radiating shunt slot disposed above it is always different compared to the amount of coupling from the tilted coupling slot to the radiating shunt slot disposed below it. As a result of this, the design of a planar shunt slot array that provides for a low sidelobe radiation pattern is very difficult. In addition, the conventional planar slot array and its feed may be made of rectangular waveguides but its monopulse network is made of a stripline medium. In this case, an extra transition between the rectangular waveguide and a stripline medium is required. This is generally undesirable because of additional costs and weight considerations.

U.S. Pat. No. 4,409,595 discloses a stripline-fed linear slot array antenna and means for controlling the resonant slot length of the linearly arranged slots. The slot array antenna uses a standing wave to form a broadside and an off broadside main beam. The plurality of linearly arranged elongated slots are fed by one continuous stripline feed conductor. The feed conductor has conductor portions each associated with one slot and each having a longitudinal axis that is angled with respect to the longitudinal axis of the associated slot. The conductor portions form a zig-zag pattern, and adjacent slots having conductor portions angled at a different direction with respect to the direction of alignment of the slots.

The U.S. Pat. No. 4,409,595 patent teaches a slot array antenna having a linear array of slots with no cross-polarization and wherein the resonant slot lengths are constrained to advantageously low values. The stripline-fed linear slot array antenna has slots fed from one continuous strip without the use of power dividing junctions. The conductor has a zig-zag pattern so that adjacent slots have conductor portions angled at a different direction with respect to the direction of alignment of the slots. Multiple arrays of this type may be stacked to form a high gain antenna with a pencil beam for radar and communications applications.

The stripline center conductor is enclosed in a dielectric-filled metal box, and the slots are located in one wall of the box. In addition to using a standing wave to form an off broadside main beam, the U.S. Pat. No. 4,409,595 invention may be used in standing wave arrays with broadside beams or in traveling wave arrays having off-broadside beams. The feeding of the slots from a single strip eliminates the multiple power dividing junctions used in other stripline fed linear slot arrays. The tilt angle of the center conductor relative to the long axis of the slot above the strip determines the amount of energy coupled from the strip to the slot. There is zero or minimum coupling when the slot and strip are parallel and maximum coupling when the slot and strip are orthogonal. Therefore a very large range of coupling values are available without varying the external slot configuration and without the use of power dividers.

The use of a linear array of slots in the outer wall of a boxed stripline has several advantages when compared to an equivalent array of slots in a $TE_{10}$ mode rectangular waveguide. The phase of individual slots in the stripline array can be arbitrarily controlled by manipulating the length of the inner conductor. The stripline characteristic impedance is easily varied by altering the width of the same conductor, a desirable feature. Extreme compactness in two-dimensional slot arrays can be achieved by use of printed circuit fabrication techniques for the slot radiators, the stripline center conductor and the feed network. The TEM line is also nondispersive, thus enabling distortion free transmission of short pulse and other more complex waveforms.

Consequently, it is an objective of the present invention to provide for an improved coupling slot arrangement that provides for coupling of energy between a boxed stripline and crossed rectangular waveguides employed in an antenna array.

SUMMARY OF THE INVENTION

The present invention comprises a centered longitudinal series/series coupling slot disposed between a boxed stripline and a crossed rectangular waveguide. The present invention also comprises an antenna array incorporating such centered longitudinal series/series coupling slots. The centered longitudinal series/series coupling slot is longitudinally disposed along the centerline of the boxed stripline in such a way the centered longitudinal slot interacts with the stripline mode and not with the rectangular waveguide mode ($TE_{10}$ mode) in the boxed stripline. As a result of this, a highly efficient standing wave (or travelling wave) feed is provided using the centered longitudinal series/series coupling slot in the boxed stripline. The centered longitudinal series/series coupling slot comprises a transverse slot in the crossed rectangular waveguide which reduces the undesirable direct higher order mode coupling between the coupling slot and adjacent radiating longitudinal shunt slots.

More particularly, the present invention comprises a coupling arrangement for use in an antenna array including a boxed meandering stripline and a rectangular waveguide disposed adjacent to the boxed meandering stripline that is oriented orthogonal to the boxed stripline and that includes a plurality of longitudinal radiating slots. The improvement provided by the present invention comprises a centered longitudinal series/series coupling slot disposed between the boxed meandering stripline and the crossed rectangular waveguide, and wherein the centered longitudinal series/series coupling slot is disposed orthogonal to the plurality of longitudinal radiating slots of the crossed rectangular waveguide, and wherein the centered longitudinal series/series coupling slot is longitudinally disposed along a centerline of the boxed meandering stripline. There is a predetermined tilt angle between the centered longitudinal series/series coupling slot and the meandering boxed stripline. The amount of coupling between the boxed meandering stripline and the rectangular waveguide is controlled by the relative tilt angle between the boxed meandering stripline and the centered longitudinal series/series coupling slot.

In addition, the present invention provides for an antenna array that comprises a boxed meandering stripline and a plurality of rectangular waveguides disposed adjacent to the boxed meandering stripline that are oriented orthogonal to the boxed stripline and that each comprises a plurality of longitudinal radiating slots. A plurality of centered longitudinal series/series coupling slots are disposed between the boxed meandering stripline and the plurality of crossed rectangular waveguides, and wherein each centered longitudinal series/series coupling slot is disposed orthogonal to the plurality of longitudinal radiating slots of an associated crossed rectangular waveguide, and wherein the centered longitudinal series/series coupling slots are longitudinally disposed along a centerline of the boxed meandering stripline.

The present invention significantly reduces undesirable direct higher order mode coupling because the coupling slot and the radiating slot are perpendicular to each other. The present invention also removes the the need for waveguide feeds and transitions. Furthermore, the feed formed using a boxed stripline and a monopulse network formed with the stripline may be laid out in the same layer.

The centered longitudinal series/series coupling slot of the present invention may be used to replace a tilted series/series coupling slot currently employed in certain seeker antennas, for example. As a result of using the present invention, the production cost of such a seeker antenna and its monopulse network may be substantially reduced by removing the feed waveguides, folded shorts, and epoxy reinforced transitions between the waveguide a stripline monopulse network. Furthermore, the design margin of the pattern sidelobe and the input impedance of the seeker antenna may be increased by removing the undesirable direct higher order mode coupling between the tilted coupling slot and the radiating slot, and by increasing the radiating waveguide height. Also, removal of the waveguide feed layer provides room for a thicker radiating waveguide.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 1 illustrates a centered longitudinal series/series coupling slot in accordance with the principles of the present invention that provides for coupling of energy between a boxed stripline and a crossed rectangular waveguide;

FIG. 2 illustrates the tilt angle associated with the centered longitudinal series/series coupling slot and the boxed stripline shown in FIG. 1;

DETAILED DESCRIPTION

Figure 3:
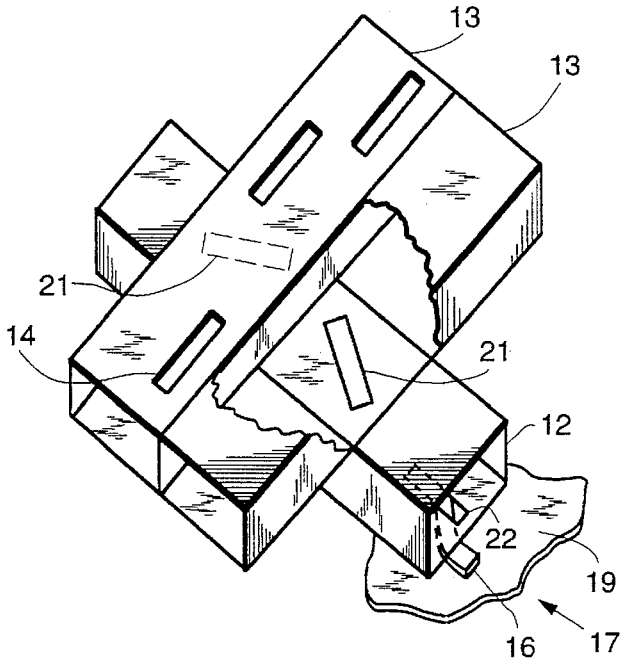
FIG. 3. ( PRIOR ART )
FIG. 3 illustrates a conventional tilted series/series coupling slot that couples energy between two crossed rectangular waveguides.

Referring to the drawing figures, FIG. 1 illustrates a portion of an antenna array 10 comprising a centered longitudinal series/series coupling slot 11 comprising a coupling arrangement in accordance with the principles of the present invention that provides for coupling of energy between a boxed stripline 12 and crossed rectangular waveguides 13 that are oriented orthogonal to the boxed stripline 12. Each rectangular waveguide 13 is comprised of a plurality of radiating slots 14 disposed in its radiating surface and the centered longitudinal series/series coupling slot 11 disposed in a wall adjacent to the boxed stripline 12. The boxed stripline 12 comprises a meandering suspended air stripline 16 that may be supported by a dielectric substrate 19. The centered longitudinal series/series coupling slot 11 of each waveguide 12 is disposed orthogonal to the plurality of radiating slots 14 thereof. FIG. 2 illustrates that there is a predetermined tilt angle between the centered longitudinal series/series coupling slot I 1 and the meandering stripline 16 of the boxed stripline 12 shown in FIG. 1.

The centered longitudinal series/series coupling slot 11 is longitudinally disposed along the centerline of the boxed stripline 12 in such a way the centered longitudinal slot 11 interacts with the stripline mode and not with the rectangular waveguide mode ($TE_{10}$ mode) in the boxed stripline 12. Consequently, a highly efficient standing wave (or travelling wave) feed is provided by the centered longitudinal series/series coupling slot 11 disposed in the boxed stripline 12. The centered longitudinal series/series coupling slot 11 forms a transverse slot in the crossed rectangular waveguide 13 which reduces the undesirable direct higher order mode coupling between the coupling slot 11 and adjacent radiating longitudinal shunt slots 14 of the crossed rectangular waveguide 13.

FIG. 3 illustrates a conventional coupling arrangement comprising a tilted series/series coupling slot 21 that couples energy between crossed rectangular wave-guides 12, 13. The crossed rectangular waveguides 13 comprise radiating waveguides 13 and include a plurality of longitudinal radiating shunt slots 14 disposed in a radiating surface thereof. The rectangular waveguide 12 is a feed rectangular waveguide 12 that has the tilted series/series coupling slot 21 disposed in a wall adjacent each of the radiating waveguides 13. A monopulse feed network 17 that may comprise a meandering suspended air stripline 16 that may be supported by a dielectric substrate 19 is coupled to the feed rectangular waveguide 12 by means of slots 22 disposed between the feed network 17 and the rectangular waveguide 12. Thus, the conventional coupling arrangement is a three layer arrangement comprising the monopulse feed network 17, rectangular waveguide 12, and the radiating rectangular waveguides 13. However, there is undesired coupling of higher order modes between the tilted series/series coupling slot 21 and the longitudinal radiating shunt slots 14. The centered longitudinal series/series coupling slot 11 of the present invention is adapted to overcome this coupling limitation and reduce the number of layers of the coupling arrangement.

The radiating slots 14 of a planar shunt slot array antenna are fed by the tilted series/series coupling slot 21 disposed between the two crossed rectangular waveguides 13 as is shown in FIG. 3. The direct higher order mode coupling between the tilted coupling slot 21 and neighboring longitudinal radiating slots 14 is strong. Furthermore, the amount of direct higher order mode coupling from the tilted coupling slot 21 to the radiating shunt slot 14 disposed above it is always different compared to the amount of coupling from the tilted coupling slot 21 to the radiating shunt slot 14 disposed below it. As a result of this, the design of a planar shunt slot array that provides for a low sidelobe radiation pattern is very difficult. In contrast, and with reference to FIG. 1, the present invention significantly reduces the undesirable direct higher order mode coupling amount because the present centered longitudinal series/series coupling slots 11 and the radiating slots 14 are perpendicular to each other.

Figure 4:
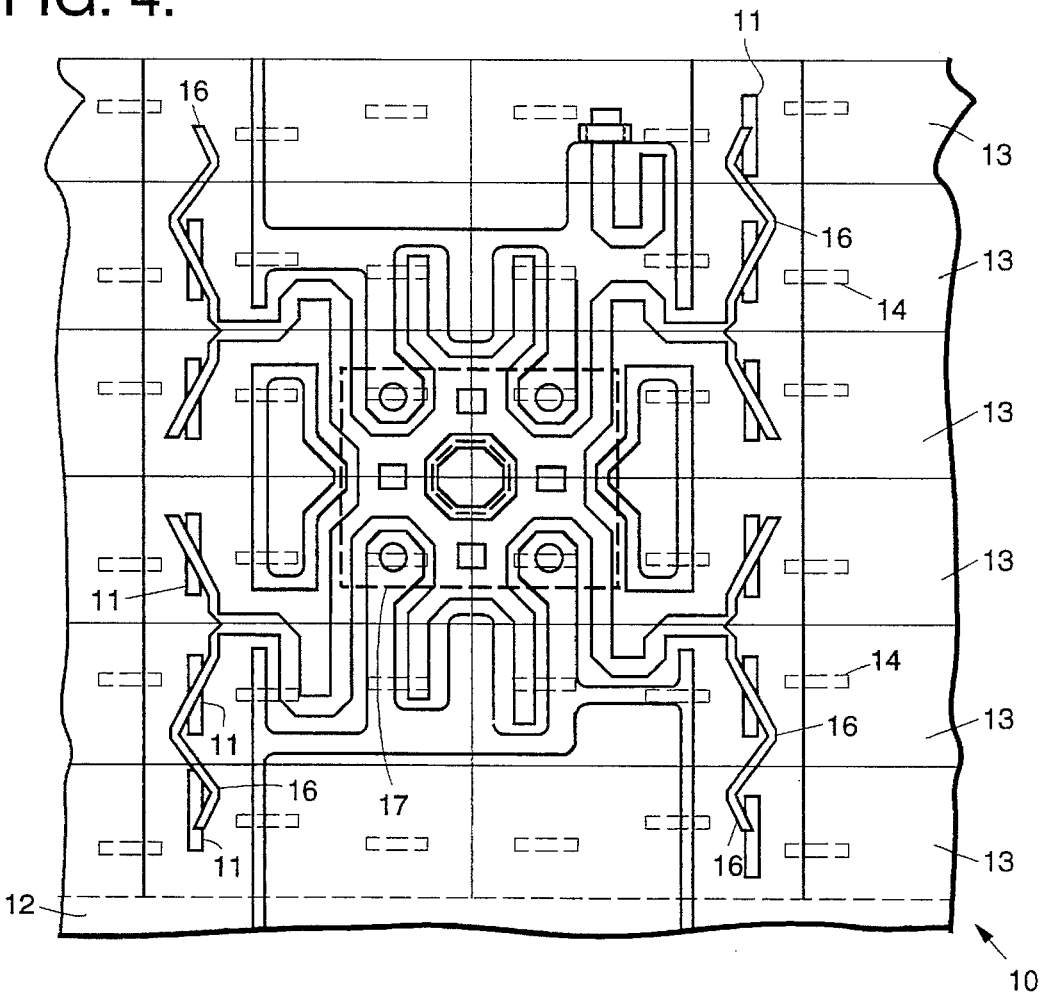
FIG. 4 illustrates a partially cutaway view of a typical antenna array employing centered longitudinal series/series coupling slots in accordance with the present invention.

FIG. 4 illustrates a partially cutaway view of a typical slot antenna array 10 employing centered longitudinal series/series coupling slots 11 in accordance with the present invention. The antenna array 10 is comprised of a plurality of crossed rectangular waveguides 13. Each of the crossed rectangular waveguides 13 comprises a plurality of radiating slots 14. The antenna array 10 is also comprised of a plurality of boxed striplines 12 that each include a plurality of centered longitudinal series/series coupling slots 11. The centered longitudinal series/series coupling slots 11 couple energy between the boxed striplines 12 and the plurality of crossed rectangular waveguides 13, by way of the meandering stripline 16. A feed network 17 is coupled to the meandering stripline 16 of each boxed stripline 12.

Often a planar slot array 10 and its feed are made of rectangular waveguides but its monopulse network comprises a stripline medium. In this case, an extra transition between the rectangular waveguide and the stripline medium is required. The present invention removes the need for these waveguide feeds and transitions. Furthermore, the feed formed using the boxed stripline 12 and a monopulse network 17 formed with the stripline 16 may be laid out in the same layer, as is illustrated in the typical layout of the slot antenna array 10 shown in FIG. 4.

In operation, since the centered longitudinal slot 11 disposed in the rectangular waveguide 13 does not couple to the waveguide mode, and because the centered longitudinal slot 11 is disposed in a relatively large width of boxed stripline 12 (greater than one-half the energy wavelength), it has a resonant slot length that permits cascading of the coupling slots 11. The coupling amounts are controlled by the stripline tilt angle relative to the centered longitudinal slot 11. As the tilt angle increases, the coupling amount increases. The phase of each coupling slot 11 is controlled by the length of the meandered stripline 16 disposed between two adjacent coupling slots 11. The centered longitudinal series/series coupling slot 11 comprises a transverse slot in the crossed rectangular waveguide 13, which reduces undesirable direct higher order mode coupling between the coupling slot 11 and the adjacent radiating longitudinal shunt slots 14.

Thus there has been described a new and improved antenna array comprising centered longitudinal series/series coupling slots that provides for coupling of energy between a boxed stripline and crossed rectangular waveguides. It is to be understood that the above-described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A coupling arrangement for use in an antenna array comprising a boxed meandering stripline and a crossed rectangular waveguide disposed adjacent to the boxed meandering stripline that is oriented orthogonal to the boxed meandering stripline and that includes a plurality of longitudinal radiating slots, wherein the improvement comprises:

a centered longitudinal series/series coupling slot disposed between the boxed meandering stripline and the crossed rectangular waveguide, and wherein the centered longitudinal series/series coupling slot is disposed orthogonal to the plurality of longitudinal radiating slots of the crossed rectangular waveguide, and wherein the centered longitudinal series/series coupling slot is longitudinally disposed along a centerline of the boxed meandering stripline.

2. The coupling arrangement of claim 1 wherein there is a predetermined tilt angle between the centered longitudinal series/series coupling slot and the boxed meandering stripline.

3. The coupling arrangement of claim 2 wherein the amount of coupling between the boxed meandering stripline and the rectangular waveguide is controlled by the relative tilt angle between the boxed meandering stripline and the centered longitudinal series/series coupling slot.

4. A coupling arrangement for use in an antenna array comprising a boxed meandering stripline and a plurality of crossed rectangular waveguides disposed adjacent to the boxed meandering stripline that are oriented orthogonal to the boxed meandering stripline and that each comprises a plurality of longitudinal radiating slots, wherein the improvement comprises:

a plurality of centered longitudinal series/series coupling slots disposed between the boxed meandering stripline and the plurality of crossed rectangular waveguides, and wherein each centered longitudinal series/series coupling slot is disposed orthogonal to the plurality of longitudinal radiating slots of an associated crossed rectangular waveguide, and wherein the centered longitudinal series/series coupling slots are longitudinally disposed along a centerline of the boxed meandering stripline.

5. The coupling arrangement of claim 4 wherein there is a predetermined tilt angle between each of the plurality of centered longitudinal series/series coupling slots and the boxed meandering stripline.

6. The coupling arrangement of claim 5 wherein the amount of coupling between the boxed meandering stripline and each of the plurality of rectangular waveguides is controlled by the relative tilt angle between the boxed meandering stripline and the respective centered longitudinal series/series coupling slots.

7. The coupling arrangement of claim 4 wherein the phase associated with each coupling slot is controlled by the length of the boxed meandered stripline disposed between two adjacent coupling slots.

8. An antenna array comprising:

a boxed meandering stripline;

a plurality of crossed rectangular waveguides disposed adjacent to the boxed meandering stripline that are oriented orthogonal to the boxed meandering stripline and that each comprises a plurality of longitudinal radiating slots; and a plurality of centered longitudinal series/series coupling slots disposed between the boxed meandering stripline and the plurality of crossed rectangular waveguides, and wherein each centered longitudinal series/series coupling slot is disposed orthogonal to the plurality of longitudinal radiating slots of an associated crossed rectangular waveguide, and wherein the centered longitudinal series/series coupling slots are longitudinally disposed along a centerline of the boxed meandering stripline.

9. The antenna array of claim 8 wherein there is a predetermined tilt angle between each of the plurality of centered longitudinal series/series coupling slots and the boxed meandering stripline.

10. The antenna array of claim 9 wherein the amount of coupling between the boxed meandering stripline and each of the plurality of rectangular waveguides is controlled by the relative tilt angle between the boxed meandering stripline and the respective centered longitudinal series/series coupling slots.

11. The antenna array of claim 8 wherein the phase associated with each coupling slot is controlled by the length of the boxed meandering stripline disposed between two adjacent coupling slots.

* * * * *